US012103751B2

(12) United States Patent
Hicks et al.

(10) Patent No.: US 12,103,751 B2
(45) Date of Patent: Oct. 1, 2024

(54) CARRIER FOR CONTAINERS

(71) Applicant: Graphic Packaging International, LLC, Atlanta, GA (US)

(72) Inventors: Douglas R. Hicks, Milton, GA (US); Kevin T. May, Kennesaw, GA (US); Raymond R. Spivey, Sr., Mableton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/859,178

(22) Filed: Jul. 7, 2022

(65) Prior Publication Data

US 2023/0008477 A1 Jan. 12, 2023

Related U.S. Application Data

(60) Provisional application No. 63/203,882, filed on Aug. 3, 2021, provisional application No. 63/219,648, filed on Jul. 8, 2021.

(51) Int. Cl.
*B65D 71/50* (2006.01)
*B65B 17/02* (2006.01)

(52) U.S. Cl.
CPC ..... *B65D 71/508* (2013.01); *B65B 17/025* (2013.01); *B65D 71/504* (2013.01)

(58) Field of Classification Search
CPC ..... B65B 17/025; B65D 21/02; B65D 71/42; B65D 71/50; B65D 71/564; B65D 71/568;

(Continued)

(56) References Cited

U.S. PATENT DOCUMENTS 1,527,399 A 2/1925 Davidson
2,289,859 A 7/1942 Arthur
(Continued)

FOREIGN PATENT DOCUMENTS

AT 399701 B 7/1995
AU 2009200835 A1 9/2009
(Continued)

OTHER PUBLICATIONS

International Search Report and Written Opinion for PCT/US2022/036297 dated Oct. 21, 2022.
(Continued)

*Primary Examiner* — Bryon P Gehman
(74) *Attorney, Agent, or Firm* — Womble Bond Dickinson (US) LLP

(57) ABSTRACT

A carrier for holding a plurality of containers includes a top retainer formed from a top container retention blank including a top attachment panel for at least partially receiving the plurality of containers, and a bottom retainer formed from a bottom container retention blank including a bottom attachment panel for being attached to the plurality of containers and having a plurality of bottom container retention tabs foldably connected to the bottom attachment panel and at least partially separable from the bottom attachment panel for being attached to a respective container of the plurality of containers, the top attachment panel is free from attachment to the bottom attachment panel.

35 Claims, 4 Drawing Sheets

(58) Field of Classification Search
CPC ..... B65D 75/00; B65D 71/403; B65D 71/70; B65D 71/71; B65D 71/72; B65D 71/504; B65D 71/508
USPC ..... 206/153, 203
See application file for complete search history.

(56) References Cited

U.S. PATENT DOCUMENTS

| | | | |
|---|---|---|---|
| 2,320,440 | A | 6/1943 | Kruea |
| 2,331,038 | A | 10/1943 | Meller |
| 2,397,376 | A | 3/1946 | Caldwell |
| 2,397,716 | A | 4/1946 | Wendler |
| 2,522,950 | A | 9/1950 | Keith |
| 2,594,376 | A | 4/1952 | Arneson |
| 2,594,377 | A | 4/1952 | Arneson |
| 2,737,326 | A | 3/1956 | Toensmeier |
| 2,798,603 | A | 7/1957 | Grinspoon |
| 2,814,385 | A | 11/1957 | Stone |
| 2,823,062 | A | 2/1958 | Toensmeier |
| 2,929,181 | A | 3/1960 | Poupitch |
| 2,936,070 | A | 5/1960 | Poupitch |
| 2,950,041 | A | 8/1960 | Stone |
| 2,965,410 | A | 12/1960 | Hughes |
| 3,001,647 | A | 9/1961 | Liss |
| 3,005,654 | A | 10/1961 | Stone et al. |
| 3,046,711 | A | 7/1962 | Harrison |
| 3,061,141 | A | 10/1962 | Cote |
| 3,094,210 | A | 6/1963 | Berg |
| 3,099,475 | A | 7/1963 | Manizza |
| 3,118,537 | A | 1/1964 | Copping |
| 3,128,034 | A | 4/1964 | Weiss |
| 3,137,109 | A | 6/1964 | Rapata |
| 3,146,885 | A | 9/1964 | Grantham |
| 3,156,358 | A | 11/1964 | Randrup |
| RE25,781 | E | 5/1965 | Akiereb |
| 3,200,944 | A | 8/1965 | Rapata |
| 3,223,308 | A | 12/1965 | Weiss |
| 3,245,711 | A | 4/1966 | Dantoin |
| 3,257,066 | A | 6/1966 | Williams |
| 3,281,180 | A | 10/1966 | Spery |
| 3,302,784 | A | 2/1967 | Copping |
| 3,317,234 | A | 5/1967 | Burford |
| 3,387,879 | A | 6/1968 | Wood |
| 3,404,912 | A | 10/1968 | Watts |
| 3,410,596 | A | 11/1968 | Slevin, Jr. |
| 3,432,202 | A | 3/1969 | Ebelhardt |
| 3,463,535 | A | 8/1969 | Beart |
| 3,515,272 | A | 6/1970 | Gal |
| 3,528,697 | A | 9/1970 | Wood |
| 3,587,847 | A | 6/1971 | Graser |
| 3,601,253 | A | 8/1971 | Poupitch |
| 3,601,439 | A | 8/1971 | Poupitch |
| 3,612,266 | A | 10/1971 | Graser |
| D222,579 | S | 11/1971 | Oglesbee |
| 3,627,121 | A | 12/1971 | Deasy |
| 3,653,503 | A | 4/1972 | Arneson |
| 3,664,497 | A | 5/1972 | Mascia |
| 3,693,787 | A | 9/1972 | Duerr |
| 3,698,550 | A | 10/1972 | Graser |
| 3,701,416 | A | 10/1972 | Lawrence |
| 3,722,945 | A | 3/1973 | Wood |
| 3,726,558 | A | 4/1973 | Klygis |
| 3,734,278 | A | 5/1973 | Kerrigan |
| 3,767,041 | A | 10/1973 | Graser |
| 3,876,066 | A | 4/1975 | Klygis |
| 3,897,873 | A | 8/1975 | Graser |
| 3,924,739 | A | 12/1975 | Gravesteijn |
| 3,942,631 | A | 3/1976 | Sutherland et al. |
| 4,029,204 | A | 6/1977 | Manizza |
| 4,078,357 | A | 3/1978 | Ida |
| 4,111,298 | A | 9/1978 | Mascia |
| 4,120,396 | A | 10/1978 | Mascia |
| 4,136,772 | A | 1/1979 | Mascia |
| 4,155,502 | A | 5/1979 | Forte |
| 4,190,149 | A | 2/1980 | Oliff et al. |
| 4,192,540 | A | 3/1980 | Oliff |
| D257,001 | S | 9/1980 | Oliff |
| 4,244,617 | A | 1/1981 | Manizza |
| 4,304,329 | A | 12/1981 | Graser |
| D265,292 | S | 7/1982 | Killy |
| 4,339,032 | A | 7/1982 | Wood |
| D265,979 | S | 8/1982 | Arfert |
| 4,372,599 | A | 2/1983 | Kiedaisch et al. |
| 4,378,879 | A | 4/1983 | Killy |
| 4,382,505 | A | 5/1983 | Sutherland et al. |
| 4,441,611 | A | 4/1984 | Sommariva |
| 4,453,630 | A | 6/1984 | Helms |
| 4,471,870 | A | 9/1984 | Uhlig |
| 4,518,081 | A | 5/1985 | de Larosiere |
| 4,523,676 | A | 6/1985 | Barrash |
| 4,566,591 | A | 1/1986 | Turtschan |
| 4,703,847 | A | 11/1987 | Oliff |
| D294,331 | S | 2/1988 | Panazzolo |
| 4,736,977 | A | 4/1988 | Killy |
| 4,784,266 | A | 11/1988 | Chaussadas |
| D304,017 | S | 10/1989 | Oliff |
| 4,911,288 | A | 3/1990 | Dantoin, Jr. |
| 4,911,289 | A | 3/1990 | Bird |
| 4,974,726 | A | 12/1990 | Klygis et al. |
| 5,002,225 | A | 3/1991 | Bienaime |
| 5,065,862 | A | 11/1991 | Mousseau |
| 5,103,971 | A | 4/1992 | Schuster |
| 5,125,506 | A | 6/1992 | Galbierz et al. |
| 5,135,104 | A | 8/1992 | Jorba |
| 5,139,147 | A | 8/1992 | Sutherland |
| D329,807 | S | 9/1992 | Heider |
| 5,186,321 | A | 2/1993 | Fadus |
| 5,188,225 | A | 2/1993 | Jorba |
| 5,193,673 | A | 3/1993 | Rathbone et al. |
| 5,201,412 | A | 4/1993 | Schuster et al. |
| 5,230,425 | A | 7/1993 | Edqvist et al. |
| 5,246,113 | A | 9/1993 | Schuster |
| 5,263,299 | A | 11/1993 | Galbierz et al. |
| 5,267,644 | A | 12/1993 | Tsao |
| 5,282,348 | A | 2/1994 | Dampier et al. |
| 5,297,673 | A | 3/1994 | Sutherland |
| 5,310,050 | A | 5/1994 | Sutherland |
| 5,310,051 | A | 5/1994 | Sutherland |
| 5,314,224 | A | 5/1994 | Bates |
| 5,318,178 | A | 6/1994 | Davies et al. |
| 5,320,216 | A | 6/1994 | Pangborn |
| 5,323,895 | A | 6/1994 | Sutherland et al. |
| 5,328,024 | A | 7/1994 | Sutherland |
| 5,335,774 | A | 8/1994 | Ganz |
| 5,351,815 | A | 10/1994 | Fogle et al. |
| 5,351,816 | A | 10/1994 | Sutherland et al. |
| 5,351,817 | A | 10/1994 | Sutherland |
| 5,355,999 | A | 10/1994 | Sutherland |
| 5,360,104 | A | 11/1994 | Sutherland |
| 5,390,784 | A | 2/1995 | Sutherland |
| 5,407,065 | A | 4/1995 | Sutherland |
| 5,415,278 | A | 5/1995 | Sutherland |
| 5,425,446 | A | 6/1995 | Weaver |
| 5,443,153 | A | 8/1995 | Sutherland |
| 5,445,262 | A | 8/1995 | Sutherland |
| 5,452,799 | A | 9/1995 | Sutherland |
| 5,469,687 | A | 11/1995 | Olson |
| 5,474,172 | A | 12/1995 | Zavatone et al. |
| 5,484,053 | A | 1/1996 | Harris |
| 5,485,914 | A | 1/1996 | Martin |
| 5,487,464 | A | 1/1996 | Galbierz et al. |
| 5,490,593 | A | 2/1996 | Gordon et al. |
| 5,503,267 | A | 4/1996 | Sutherland |
| 5,520,283 | A | 5/1996 | Sutherland |
| 5,524,756 | A | 6/1996 | Sutherland |
| 5,542,536 | A | 8/1996 | Sutherland |
| 5,551,566 | A | 9/1996 | Sutherland |
| 5,553,704 | A | 9/1996 | Gordon et al. |
| 5,553,705 | A | 9/1996 | Bakx |
| 5,573,111 | A | 11/1996 | Gordon |
| 5,590,776 | A | 1/1997 | Galbierz |
| 5,593,027 | A | 1/1997 | Sutherland |
| 5,609,247 | A | 3/1997 | Appleton |
| 5,609,251 | A | 3/1997 | Harris |

(56) References Cited

U.S. PATENT DOCUMENTS

| | | | |
|---|---|---|---|
| 5,609,379 | A | 3/1997 | Harrelson |
| 5,627,150 | A | 5/1997 | Peterson |
| 5,639,137 | A | 6/1997 | Bakx |
| 5,682,982 | A | 11/1997 | Stonehouse |
| 5,706,936 | A | 1/1998 | Bernstein |
| 5,711,419 | A | 1/1998 | Beales et al. |
| 5,718,330 | A | 2/1998 | Auffret et al. |
| 5,735,394 | A | 4/1998 | Harrelson |
| 5,746,310 | A | 5/1998 | Slomski |
| 5,762,193 | A | 6/1998 | Marco |
| 5,791,463 | A | 8/1998 | Negelen |
| 5,791,464 | A | 8/1998 | Galbierz et al. |
| 5,816,391 | A | 10/1998 | Harris |
| 5,845,776 | A | 12/1998 | Galbierz et al. |
| 5,878,876 | A | 3/1999 | Galbierz et al. |
| 5,960,945 | A | 10/1999 | Sutherland |
| 6,039,181 | A | 3/2000 | Whiteside |
| 6,059,099 | A | 5/2000 | Galbierz |
| 6,082,532 | A | 7/2000 | Miess |
| 6,145,656 | A | 11/2000 | Marco |
| 6,168,012 | B1 | 1/2001 | Galbierz |
| 6,293,392 | B1 | 9/2001 | Galbierz |
| 6,315,111 | B1 | 11/2001 | Sutherland |
| 6,394,272 | B1 | 5/2002 | Domansky |
| 6,896,130 | B2 | 5/2005 | Theelen |
| D506,925 | S | 7/2005 | Plumer |
| 7,011,209 | B2 | 3/2006 | Sutherland et al. |
| 7,048,113 | B2 | 5/2006 | Gomes |
| 7,360,647 | B2 * | 4/2008 | Ogg ..... B65D 71/42 206/139 |
| 7,690,507 | B2 | 4/2010 | Sutherland |
| 7,721,878 | B2 | 5/2010 | Requena |
| 7,762,397 | B2 | 7/2010 | Coltri-Johnson et al. |
| 7,789,231 | B2 | 9/2010 | Requena |
| 7,823,721 | B2 | 11/2010 | Sutherland et al. |
| 7,913,844 | B2 | 3/2011 | Spivey, Sr. |
| 8,056,709 | B2 | 11/2011 | Sutherland |
| 8,096,413 | B2 | 1/2012 | DePaula |
| 8,113,968 | B2 | 2/2012 | Fittler |
| 8,162,135 | B2 | 4/2012 | Oliveira |
| 8,353,398 | B2 | 1/2013 | DePaula et al. |
| 8,387,784 | B2 | 3/2013 | Gonzalez et al. |
| 8,443,968 | B2 | 5/2013 | DePaula |
| 8,464,866 | B2 | 6/2013 | Sutherland et al. |
| 8,469,184 | B2 | 6/2013 | Spivey, Sr. |
| 8,602,209 | B2 | 12/2013 | Jones et al. |
| 8,631,932 | B2 | 1/2014 | Holley, Jr. |
| 8,701,878 | B2 | 4/2014 | Spivey, Sr. |
| 8,925,720 | B2 | 1/2015 | Sutherland et al. |
| 8,936,149 | B2 | 1/2015 | Smalley |
| 8,955,674 | B2 | 2/2015 | Spivey, Sr. et al. |
| 9,004,344 | B2 | 4/2015 | Smith |
| 9,079,699 | B2 | 7/2015 | Holley, Jr. |
| 9,169,050 | B2 | 10/2015 | Spivey, Sr. |
| 9,284,090 | B2 | 3/2016 | Lettre |
| 9,359,093 | B2 | 6/2016 | DePaula et al. |
| 9,376,250 | B2 | 6/2016 | Spivey, Sr. |
| D767,408 | S | 9/2016 | Shuster |
| 9,446,891 | B2 | 9/2016 | Jones et al. |
| 9,511,916 | B2 | 12/2016 | Holley, Jr. |
| D786,702 | S | 5/2017 | Borg et al. |
| 9,669,976 | B2 | 6/2017 | Kastanek et al. |
| 9,676,535 | B2 | 6/2017 | Spivey, Sr. |
| 10,077,131 | B2 | 9/2018 | Lettre |
| 10,293,998 | B2 | 5/2019 | Borg et al. |
| D881,021 | S | 4/2020 | Bandinu |
| D881,718 | S | 4/2020 | Bandinu |
| 10,836,550 | B2 | 11/2020 | Zacherle |
| D918,057 | S | 5/2021 | L'Heureux |
| D918,058 | S | 5/2021 | L'Heureux |
| 11,014,727 | B2 | 5/2021 | McCree |
| D920,809 | S | 6/2021 | Chesnet et al. |
| D921,493 | S | 6/2021 | Chesnet |
| D923,416 | S | 6/2021 | Luciano |
| 11,027,904 | B2 | 6/2021 | McCree |
| 11,027,905 | B2 | 6/2021 | Ford |
| 11,180,301 | B2 | 11/2021 | Smalley |
| D944,656 | S | 3/2022 | Spivey, Sr. |
| D946,416 | S | 3/2022 | Smalley |
| D946,417 | S | 3/2022 | Gonzalez Manzano |
| D946,418 | S | 3/2022 | Gonzalez Manzano |
| D946,419 | S | 3/2022 | Gonzalez Manzano |
| D946,420 | S | 3/2022 | Gonzalez Manzano |
| D946,421 | S | 3/2022 | Gonzalez Manzano |
| 11,261,013 | B2 | 3/2022 | Smalley |
| 11,286,094 | B2 | 3/2022 | Gonzalez Manzano |
| D955,889 | S | 6/2022 | Gonzalez Manzano |
| D955,890 | S | 6/2022 | Gonzalez Manzano |
| D956,574 | S | 7/2022 | Gonzalez Manzano |
| 11,401,094 | B2 | 8/2022 | McCree |
| 11,401,095 | B2 | 8/2022 | Rosenbrien |
| 11,420,802 | B2 | 8/2022 | Kooc |
| D962,789 | S | 9/2022 | Noel |
| 11,447,317 | B2 | 9/2022 | Zacherle et al. |
| D974,923 | S | 1/2023 | Smalley |
| 11,628,994 | B2 | 4/2023 | McCree |
| 2002/0195371 | A1 | 12/2002 | Brown |
| 2003/0080004 | A1 | 5/2003 | Olsen et al. |
| 2003/0213705 | A1 | 11/2003 | Woog |
| 2004/0007480 | A1 | 1/2004 | Pattee et al. |
| 2004/0134799 | A1 | 7/2004 | Mattson |
| 2004/0206639 | A1 | 10/2004 | Karlsson |
| 2004/0211695 | A1 | 10/2004 | Karlsson |
| 2004/0226833 | A1 | 11/2004 | Daniel |
| 2005/0127151 | A1 | 6/2005 | Johnson |
| 2005/0199513 | A1 | 9/2005 | Bakx et al. |
| 2006/0255114 | A1 | 11/2006 | Hand et al. |
| 2007/0080084 | A1 | 4/2007 | Sutherland |
| 2007/0163908 | A1 | 7/2007 | Sutherland |
| 2007/0193889 | A1 | 8/2007 | Olsen et al. |
| 2008/0257763 | A1 | 10/2008 | Ogg |
| 2009/0101526 | A1 | 4/2009 | Sutherland et al. |
| 2009/0127147 | A1 | 5/2009 | Sutherland |
| 2010/0078337 | A1 | 4/2010 | Sutherland et al. |
| 2010/0264043 | A1 | 10/2010 | DePaula |
| 2011/0000799 | A1 | 1/2011 | Gonzalez |
| 2012/0080328 | A1 | 4/2012 | DePaula |
| 2012/0138489 | A1 | 6/2012 | Holley, Jr. |
| 2015/0191287 | A1 | 7/2015 | L'Heureux et al. |
| 2016/0159546 | A1 | 6/2016 | Cassidy |
| 2016/0280436 | A1 | 9/2016 | Taylor et al. |
| 2016/0325899 | A1 | 11/2016 | L'Heureux et al. |
| 2018/0111734 | A1 | 4/2018 | Jego |
| 2018/0222650 | A1 | 8/2018 | Zacherle |
| 2018/0362234 | A1 | 12/2018 | L'Heureux et al. |
| 2019/0119019 | A1 | 4/2019 | Patton |
| 2020/0010255 | A1 | 1/2020 | Zacherle et al. |
| 2020/0079564 | A1 | 3/2020 | Ford |
| 2020/0189817 | A1 | 6/2020 | Smalley |
| 2020/0189818 | A1 | 6/2020 | McCree |
| 2020/0189819 | A1 | 6/2020 | McCree |
| 2020/0189821 | A1 | 6/2020 | Smalley |
| 2020/0189822 | A1 | 6/2020 | Smalley |
| 2020/0223612 | A1 | 7/2020 | Swenson |
| 2021/0061502 | A1 | 3/2021 | Johnston |
| 2021/0094742 | A1 | 4/2021 | Gonzalez Manzano |
| 2021/0276776 | A1 | 9/2021 | Zammit |
| 2021/0316921 | A1 | 10/2021 | Holtz |
| 2021/0331847 | A1 | 10/2021 | Gonzalez Manzano |
| 2021/0331848 | A1 | 10/2021 | Gonzalez Manzano |
| 2021/0339928 | A1 | 11/2021 | Blin |
| 2022/0009685 | A1 | 1/2022 | Thompson |
| 2022/0097941 | A1 | 3/2022 | McCree |
| 2023/0019145 | A1 | 1/2023 | Thompson |

FOREIGN PATENT DOCUMENTS

| | | |
|---|---|---|
| CA | 2133827 | 10/1993 |
| DE | 298 13 672 U1 | 11/1998 |
| DE | 203 19 247 U1 | 5/2004 |
| DE | 10 2009 059 047 A1 | 6/2011 |
| DE | 20 2018 106 535 | 1/2019 |
| EP | 0 051 413 A1 | 5/1982 |
| EP | 0 060 504 A2 | 9/1982 |

(56) References Cited

FOREIGN PATENT DOCUMENTS

| | | | |
|---|---|---|---|
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 1 340 691 | A1 | 9/2003 |
| EP | 1 401 727 | B1 | 6/2006 |
| EP | 1 910 187 | B1 | 3/2009 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| EP | 3 666 685 | A1 | 6/2020 |
| ES | 2159235 | | 9/2001 |
| FR | 2 737 196 | A1 | 1/1997 |
| GB | 1 256 684 | | 12/1971 |
| GB | 2 221 666 | A | 2/1990 |
| GB | 2 321 229 | A | 7/1998 |
| GB | 9006736716 | | 8/2019 |
| GB | 2591535 | A | 8/2021 |
| GB | 6161591 | | 9/2021 |
| JP | 37-15730 | | 9/1960 |
| JP | 10-194330 | A | 7/1998 |
| JP | 10-297668 | A | 11/1998 |
| JP | 11-193059 | | 7/1999 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| JP | 2016-124605 | | 7/2016 |
| KR | 10-2005-0051616 | A | 6/2005 |
| KR | 10-2020-0106806 | A | 9/2020 |
| KR | 301130233 | | 10/2021 |
| WO | WO 91/05716 | A1 | 5/1991 |
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 95/10459 | A1 | 4/1995 |
| WO | WO 95/22495 | A1 | 8/1995 |
| WO | WO 96/26128 | A1 | 8/1996 |
| WO | WO 96/32340 | A1 | 10/1996 |
| WO | WO 03/016167 | A1 | 2/2003 |
| WO | WO 2006/044583 | A2 | 4/2006 |
| WO | WO 2008/058294 | A1 | 5/2008 |
| WO | WO 2009/023822 | A1 | 2/2009 |
| WO | WO 2010/006629 | A1 | 1/2010 |
| WO | WO 2010/101852 | A1 | 9/2010 |
| WO | WO 2016/008744 | A1 | 1/2016 |
| WO | WO 2016/100010 | A1 | 6/2016 |
| WO | WO 2016/112145 | A1 | 7/2016 |
| WO | WO 2020/210562 | A1 | 10/2020 |
| WO | WO 2021/038516 | A1 | 3/2021 |
| WO | WO 2021/168417 | A1 | 8/2021 |
| WO | WO 2021/188751 | A1 | 9/2021 |
| WO | WO 2021/262858 | A1 | 12/2021 |

OTHER PUBLICATIONS

"Florida brewery unveils six-pack rings that spare sea turtles, not snare them," by Thomas Leavy, CBSNews.com. Date posted: May 24, 2018. Site visited: Sep. 12, 2022. Available online: https://www.cbsnews.com/news/ florida-saltwater-brewery-non-plastic-six-pack-rings-spare-sea-turtles/ (Year: 2018).

"Pepsi trials molded pulp alternative to plastic rings" in BeverageDaily.com. Date posted: Feb. 28, 2020. Site visited: Sep. 12, 2022. Available online: https://www.beveragedaily.com/Article/2020/02/28/Pepsi-trials-molded-pulp-alternative-to-plastic-rings# (Year: 2020).

Enviroclip. Date posted: 2022. Site visited: Sep. 12, 2022. Available online: https://www.graphicpkg.com/products/enviroclip/ (Year: 2022).

"Paperboard Can Handle Applicator," as seen in Packaging World Online. Date first available: 2020. Site visited: Sep. 13, 2022. Available online: https://www.packworld.com/news/sustainability/article/21202650/paperboard-can-handle-applicator (Year: 2020).

"The 'ECOGRIP' Corrugated Bottle Carrier is a Plastic Alternative" in Trendhunter.com. Date published: Jan. 20, 2021. Site visited: Sep. 12, 2022. Available online: https://www.trendhunter.com/trends/corrugated-bottle-carrier (Year: 2021).

Cap-it packaging video on Vimeo. Date posted: 2021. Site visited: Sep. 19, 2022. Available online: https://vimeo.com/610619455?embedded=true&source=vimeo_logo&owner=24551687 (Year: 2021).

2020 Package of the Year and Innovation of the Year on YouTube. Date posted: Oct. 19, 2020. Site visited: Sep. 12, 2022. Available online: https://www.youtube.com/watch?v=wxwpM4hodFA (Year: 2020).

International Search Report and Written Opinion for PCT/US2022/032608 dated Sep. 28, 2022.

International Search Report and Written Opinion for PCT/US2022/035207 dated Oct. 14, 2022.

International Search Report and Written Opinion for PCT/US2022/034840 dated Oct. 21, 2022.

International Search Report and Written Opinion for PCT/US2022/037069 dated Oct. 28, 2022.

International Search Report and Written Opinion for PCT/US2022/037071 dated Nov. 2, 2022.

International Search Report and Written Opinion for PCT/US2022/038638 dated Nov. 8, 2022.

U.S. Appl. No. 17/835,127, filed Jun. 8, 2022.

U.S. Appl. No. 29/838,182, filed May 11, 2022.

U.S. Appl. No. 17/851,200, filed Jun. 8, 2022.

U.S. Appl. No. 17/848,682, filed Jun. 24, 2022.

U.S. Appl. No. 29/838,178, filed May 11, 2022.

U.S. Appl. No. 29/838,181, filed May 11, 2022.

U.S. Appl. No. 29/838,184, filed May 11, 2022.

U.S. Appl. No. 17/864,590, filed Jul. 14, 2022.

U.S. Appl. No. 29/838,186, filed May 11, 2022.

U.S. Appl. No. 17/864,664, filed Jul. 14, 2022.

U.S. Appl. No. 17/875,755, filed Jul. 28, 2022.

U.S. Appl. No. 29/838,187, filed May 11, 2022.

U.S. Appl. No. 29/838,188, filed May 11, 2022.

* cited by examiner

CARRIER FOR CONTAINERS

CROSS-REFERENCE TO RELATED APPLICATIONS

This application claims the benefit of each of U.S. Provisional Patent Application No. 63/219,648, filed on Jul. 8, 2021, and U.S. Provisional Patent Application No. 63/203,882, filed on Aug. 3, 2021.

INCORPORATION BY REFERENCE

The disclosures of each of U.S. Provisional Patent Application No. 63/219,648, filed on Jul. 8, 2021, U.S. Provisional Patent Application No. 63/203,882, filed on Aug. 3, 2021, and U.S. Design patent application Ser. No. 29/838,184, filed on May 11, 2022, are hereby incorporated by reference for all purposes as if presented herein in their entirety.

BACKGROUND OF THE DISCLOSURE

The present disclosure generally relates to carriers or cartons for holding and carrying containers.

SUMMARY OF THE DISCLOSURE

According to one aspect, the disclosure is generally directed to a carrier for holding a plurality of containers, the carrier comprising a top retainer comprising a top attachment panel for at least partially receiving the plurality of containers, and a bottom retainer comprising a bottom attachment panel for being attached to the plurality of containers.

According to another aspect, the disclosure is generally directed to the combination of a top container retention blank and a bottom retention container blank for forming a carrier for holding a plurality of containers, the combination comprising a top container retention blank comprising a top attachment panel for at least partially receiving the plurality of containers when the carrier is formed from the top container retention blank and the bottom container retention blank, and a bottom container retainer retention blank comprising a bottom attachment panel for being attached to the plurality of containers when the carrier is formed from the combination of the top container retention blank and the bottom container retention blank.

According to another aspect, the disclosure is generally directed to a method of forming a carrier for holding a plurality of containers, the method comprising obtaining a top container retention blank comprising a top attachment panel, obtaining a bottom container retention blank comprising a bottom attachment panel, arranging the top attachment panel to form a top retainer for at least partially receiving the plurality of containers, and arranging the bottom attachment panel to form a bottom retainer for being attached to the plurality of containers.

According to another aspect, the disclosure is generally directed to a package, the package comprising a plurality of containers, and a carrier holding the plurality of containers. The carrier comprises a top retainer comprising a top attachment panel at least partially receiving the plurality of containers, and a bottom retainer comprising a bottom attachment panel attached to the plurality of containers.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to constructs, sleeves, cartons, or the like, and packages for holding and displaying containers such as cans, jars, bottles, etc. The containers can be used for packaging food and beverage products, for example. The containers can be made from materials suitable in composition for packaging the particular food or beverage item, and the materials include, but are not limited to, aluminum and/or other metals, plastics such as PET, LDPE, LLDPE, HDPE, PP, PS, PVC, EVOH, and Nylon; and the like; glass; or any combination thereof.

Packages and carriers according to the present disclosure can accommodate containers of numerous different shapes. For the purpose of illustration and not for the purpose of limiting the scope of the disclosure, the following detailed description describes beverage containers (e.g., generally cylindrical containers such as aluminum cans) at least partially disposed within the package and carrier embodiments. In this specification, the terms "lower," "bottom," "upper" and "top" indicate orientations determined in relation to fully erected packages and carriers.

As described herein, packages and carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
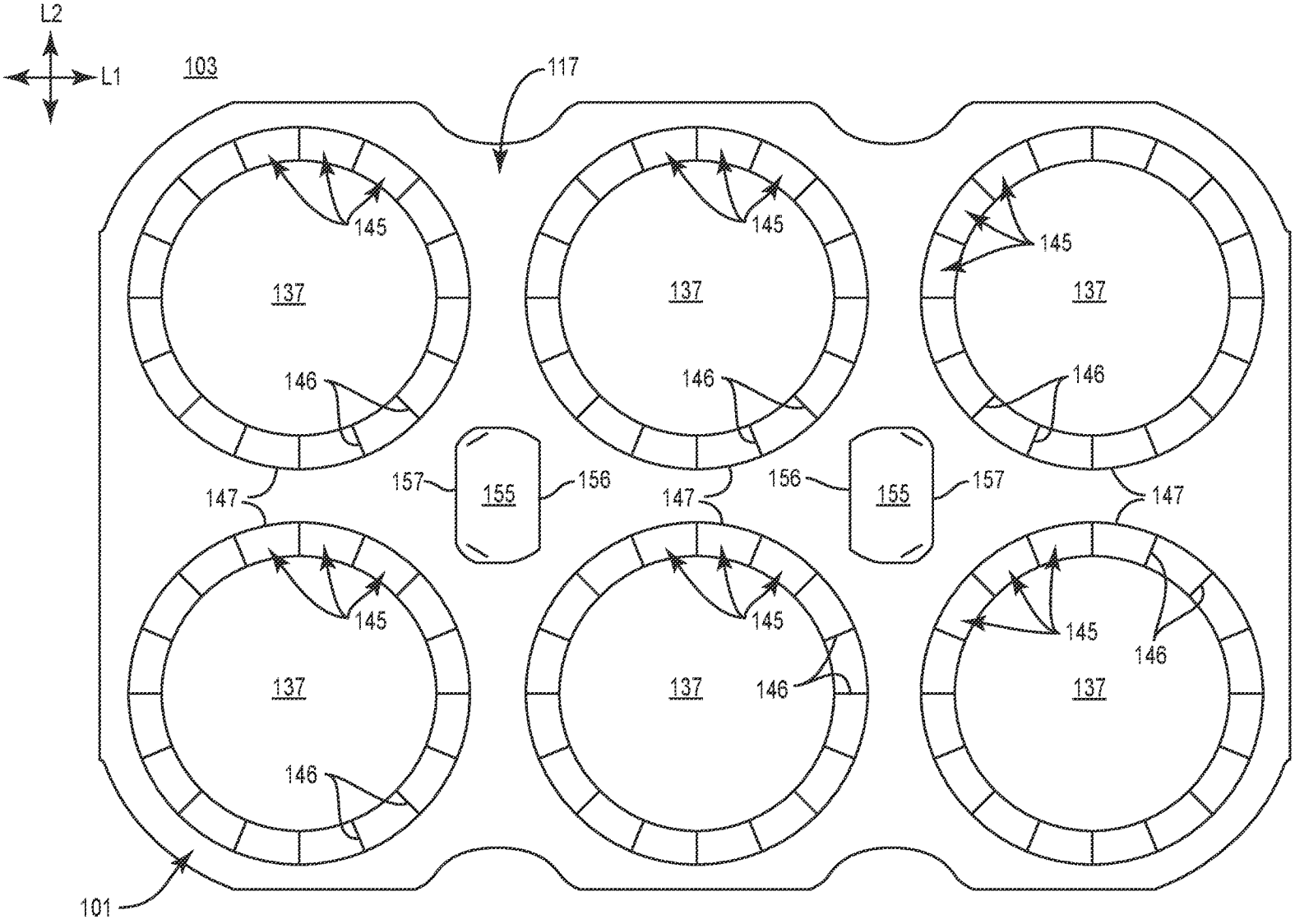
FIG. 1 is a plan view of a top container retention blank for forming a carrier according to a first exemplary embodiment of the disclosure.
Figure 3:
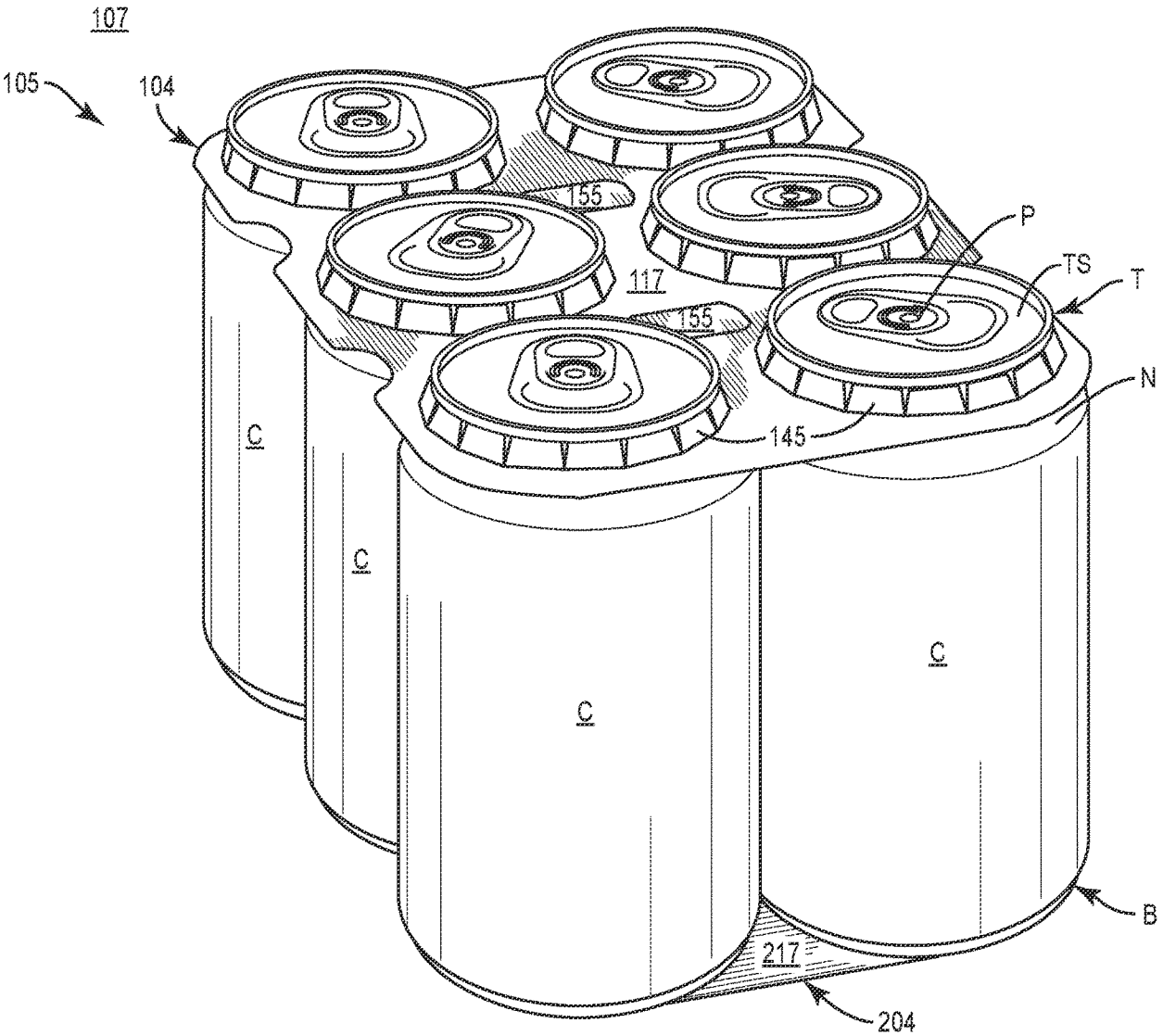
FIG. 3 is a perspective view of a carrier and package formed from the blanks of FIGS. 1 and 2 according to the first exemplary embodiment of the disclosure.

FIG. 1 is a plan view of an exterior surface 101 of a top container retention blank 103 used to at least partially form a top portion of a carrier 105 (FIG. 3) according to an exemplary embodiment of the disclosure. As described further herein, the carrier 105 can be configured for holding/supporting/retaining/receiving a plurality of containers C. The carrier 105 can be provided with one or more containers C to form a package 107 (FIG. 3).

As described herein, the top container retention blank 103 can be provided in combination with a bottom container retention blank 203 (FIG. 2) to form the carrier 105/package 107. The bottom container retention blank 203 can form a bottom portion of the carrier 105. In this regard, the top container retention blank 103 can form a top retainer 104 of the carrier 105 and the bottom container retention blank 203 can form a bottom retainer 104 of the carrier 105.

Figure 2:
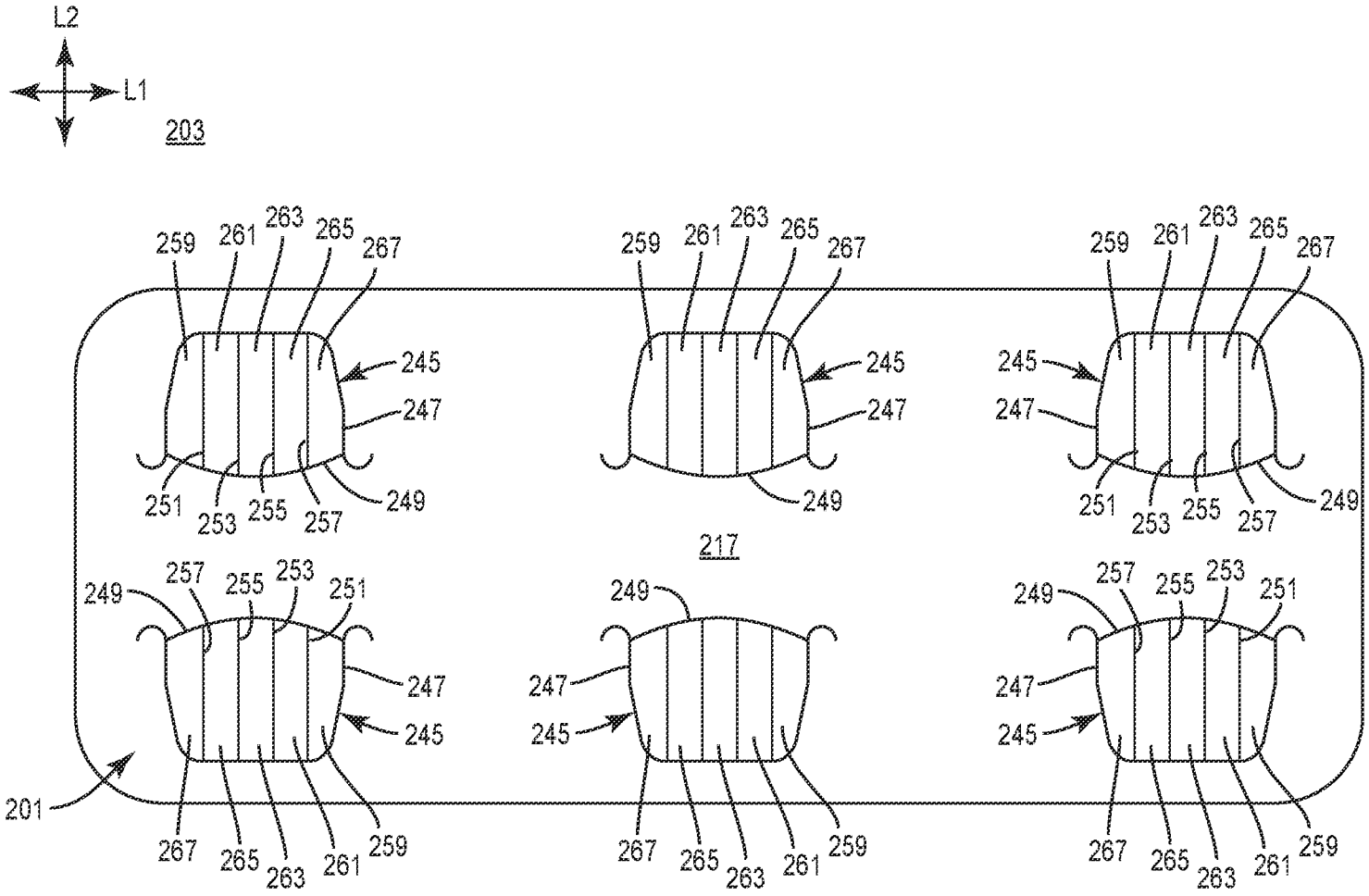
FIG. 2 is a plan view of a bottom container retention blank for forming a carrier according to the first exemplary embodiment of the disclosure.

As shown in FIG. 2, containers C for use with the carriers of the present disclosure are illustrated as beverage containers having a lower base portion B, a top portion T generally comprising a neck N that tapers inwardly from the lower base portion, a flange portion F at the top of the neck portion that extends radially outward from the neck portion, and a top surface TS below the flange portion that includes a pull-tab P. Containers of other sizes, shapes, and configurations, may be held in the carriers without departing from the disclosure.

Referring to FIG. 1, the top container retention blank 103 has a longitudinal axis L1 and a lateral axis L2. The blank 103 comprises a top central panel or attachment panel 117 that includes top container retention features for engaging containers C when the carrier 105 is formed from the blank 103. In the illustrated embodiment, the top container retention features include six container retention openings 137 in the top attachment panel 117.

The top container retention features can also include a plurality of container retention tabs (broadly, "top container retention tabs") 145 foldably attached to the central panel 117 at respective fold lines 147 and circumferentially arranged to extend into the respective container retention openings 137. In the illustrated embodiment, the container retention tabs 145 can be positioned in generally abutting relation and separated from one another at cut lines 146. In one embodiment, one or more pairs of adjacent container retention tabs 145 can be spaced apart from one another.

While the container retention tabs 145 are illustrated as generally trapezoidal elements with their wider end foldably attached to the top central panel 117, it will be understood that the shape and geometry of the container retention openings 137 and/or the container retention tabs 145 or of other/additional container retention features of the blank 103/carrier 105, could vary to increase the retention forces applied to the container C and/or to accommodate various sizes and configurations of containers, without departing from the scope of the disclosure.

The blank 103/carrier 105 can also include handle features that include one or more handle flaps 155 foldably connected to the attachment panel 117 at respective lateral fold lines 156 and at least partially defined by respective cuts 157 so as to be at least partially separable from the attachment panel 117 for exposing a handle opening. As shown, the cuts 157 can have one or more curved, angled, and or straight portions so as to have a generally tapered bracket-shaped profile. In one embodiment, the handle features of the blank 103/carrier 105 can include one or more cutouts formed in the attachment panel 117.

Turning to FIG. 2, an exterior surface 201 of the bottom container retention blank 203 is illustrated. As shown, the bottom container retention blank 203 has the longitudinal axis L1 and the lateral axis L2, and includes a bottom central panel or bottom attachment panel 217 that is free from attachment to the top attachment panel 117.

The bottom container retention blank 203 can include bottom container retention features that include a plurality of container retention tabs 245 (broadly, "bottom container retention tabs") that are at least partially defined by curved cuts 247 and foldably connected to the attachment panel 217 at respective curved fold lines 249. As shown, each container retention tab 245 can include a plurality of lateral fold lines or lines of weakening 251, 253, 255, 257 to define a plurality of adjacent and reconfigurable sections 259, 261, 263, 265, 267 to facilitate at least partial reconfiguration of the container retention tabs 245, as described further herein.

In this regard, adjacent reconfigurable sections 259, 261, 263, 265, 267 can be repositionable relative to one another at the respective lines of weakening 251, 253, 255, 257. It will be understood that the container retention tabs 245 can include a different number, configuration, and/or arrangement of lines of weakening and associated reconfigurable sections without departing from the disclosure.

Figure 4:
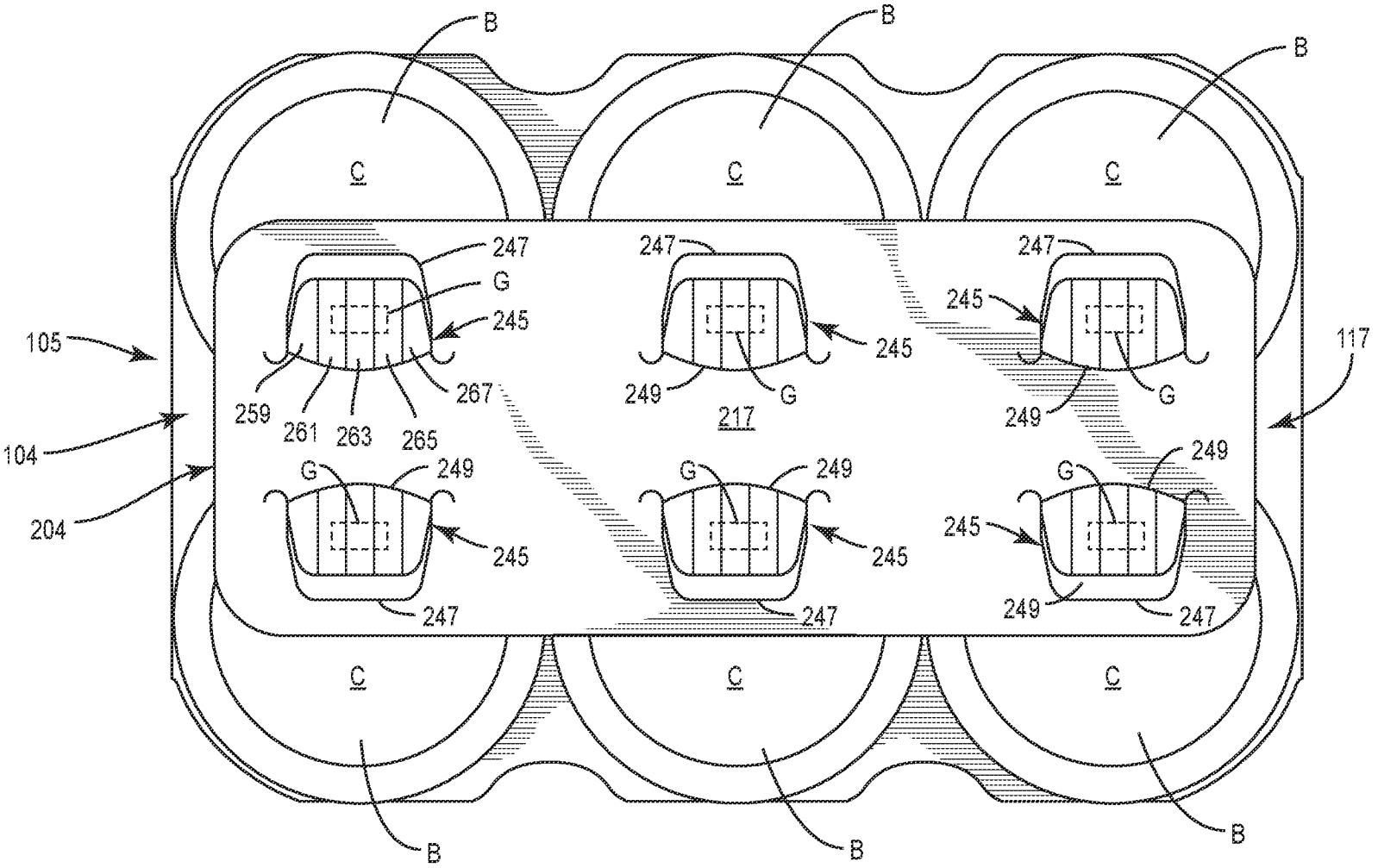
FIG. 4 is a bottom view of the carrier and package of FIG. 3.

Still referring to FIG. 1, and referring additionally to FIGS. 3 and 4, in one embodiment, a method of forming a package 107 that includes the carrier 105 and one or more of the containers C comprises obtaining the top container blank 103/top retainer 104 and obtaining the group of containers C (e.g., six containers, but more or less than six containers can be included in the package). The blank 103/retainer 104 can be positioned on top of the group of containers C and the attachment panel 117 of the blank 103/retainer 104 is pushed downward so that the flanges of the containers C are inserted through a respective opening 137.

Upon pressing the blank 103/retainer 104 downward onto the containers C, the retention container retention tabs 145 can be urged to fold upwardly at the respective fold lines 147 and at least partially separate from one another at respective cuts 146 to contact a respective container C at the neck portion thereof below a respective flange F. Such upward/oblique arrangement of the container retention tabs 145 extending from the top attachment panel 117 to a top structure of the respective containers C, e.g., flanges F or rims, can provide a reinforced, braced, stabilized, etc. engagement of the top container retention blank 103/top retainer 104 with the containers C.

As also shown, the bottom container retention blank 203/bottom retainer 204 can be engaged with and attached to bottom portions of the respective containers C. In the illustrated embodiment, the bottom attachment panel 217 can be positioned in a generally planar relationship with base portions B of the containers C, e.g., rims or lips formed along the base portions B thereof. In such an arrangement, the top attachment panel 117 can be positioned in generally spaced and parallel relation to the bottom attachment panel 217.

Simultaneously or thereafter, the respective container retention tabs 245 can be separated from the bottom attachment panel 217 at the respective cuts 247 and folded upwardly at the respective fold lines 249 into engagement with the respective containers C.

In this regard, the container retention tabs 245 can at least partially reconfigure, e.g., fold, flex, bend, contour, etc. at the respective fold lines 251, 253, 255, 257 to at least partially contour/extend around the bottom rim/bottom structure of the respective generally cylindrical containers C. In some embodiments, the bottom structure of the respective containers C can have the form of a curved recess such that the respective reconfigurable sections 259, 261, 263, 265, 267 can reposition via relative folding at the fold lines 251, 253, 255, 257, with each reconfigurable section 259, 261, 263, 265, 267 obliquely arranged relative to an adjacent reconfigurable section so as to approximate the curvature of the base portion B of the respective containers C to which they are attached.

In some embodiments, the curved fold lines 249 can facilitate such contoured engagement of the container retention tabs 245 with the respective containers C, e.g., by facilitating the aforementioned repositioning of the reconfigurable sections 259, 261, 263, 265, 267 so as to avoid bunching, buckling, creasing, or other unwanted tensioning or deformation of the container retention tabs 245 or surrounding portions of the bottom attachment panel 217. Such engagement of the container retention tabs 245 with the containers C can be achieved/maintained with an adhesive such as glue G (shown in hidden lines in FIG. 4). In one embodiment, one or more of the container retention tabs 245 can contour about a vertical side of the container C.

The aforementioned arrangement of the bottom container retention blank 203/bottom retainer 204 with the containers C can stabilize, e.g., inhibit/prevent/minimize/avoid undesirable shifting/tilting of the bottoms of the containers C so as to provide a more secure carrier 105/package 107. Accordingly, the engagement of the container retention tabs 245 with the containers C and their connection to each other via the attachment panel 217 can bind/attach/connect the bottom portions of the containers C for stabilizing effect on the carrier 105/package 107.

It will be understood that the bottom container retention blank 203/bottom retainer 204 can engage one or more of the containers C in a different manner with the result of attaching a bottom portion of the one or more of the containers C to another container C.

In this regard, the bottom container retention blank 203/bottom retainer 204 can stabilize the containers C of the carrier 105/package 107 so as to assist/minimize the support given to the containers C by the features of the top container retention blank 103/top retainer 104. Accordingly, the top container retention blank 103/top retainer 104 can be selected with a relatively low gauge/weight, stiffness, strength, can have minimized container retention features, etc., for example, as compared to a carrier 105 that is devoid of a bottom container retention blank 203/bottom retainer 204.

It will be understood that the blanks and carriers described herein can have one or more additional/alternative features without departing from the disclosure. For example, in one embodiment, the bottom container retention blank can be applied to containers without the use or with a minimized/optimized use of adhesive, e.g., so as to have one or more surfaces/edges that mechanically engage portions of the respective containers. In another embodiment, a carrier/package can be devoid of a bottom container retention blank.

The blanks according to the present disclosure can be, for example, formed from coated paperboard and similar materials. For instance, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the disclosure, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a top retainer formed from a top container retention blank comprising a top attachment panel for at least partially receiving the plurality of containers; and a bottom retainer formed from a bottom container retention blank comprising a bottom attachment panel for being attached to the plurality of containers and comprising a plurality of bottom container retention tabs foldably connected to the bottom attachment panel and at least partially separable from the bottom attachment panel at a respective cut in the bottom attachment panel for being attached to a respective container of the plurality of containers, each bottom container retention tab of the plurality of bottom container retention tabs comprises a plurality of lines of weakening defining a plurality of reconfigurable sections of the respective bottom container retention tab, the top attachment panel is free from attachment to the bottom attachment panel.

2. The carrier of claim 1, wherein each reconfigurable section of the plurality of reconfigurable sections is repositionable relative to an adjacent reconfigurable section of the plurality of reconfigurable sections at the respective line of weakening.

3. The carrier of claim 2, wherein each bottom container retention tab of the plurality of bottom container retention tabs is foldably connected to the bottom attachment panel at a respective curved fold line.

4. The carrier of claim 3, wherein the plurality of bottom container retention tabs is for being adhered to a respective container of the plurality of containers with glue.

5. The carrier of claim 1, wherein the top retainer comprises top container retention features, the top container retention features comprising a plurality of container openings for at least partially receiving a respective container of the plurality of containers.

6. The carrier of claim 5, wherein the top container retention features further comprises a plurality of top container retention tabs foldably connected to the top attachment panel and positioned extending into a respective container opening of the plurality of container openings for engaging a respective container of the plurality of containers.

7. The carrier of claim 1, wherein the top attachment panel is in generally parallel and spaced relation to the bottom panel.

8. The carrier of claim 1, wherein the plurality of bottom container retention tabs are for being at least partially received in a recess of a respective container of the plurality of containers.

9. A carrier for holding a plurality of containers, the carrier comprising:

a top retainer comprising a top attachment panel for at least partially receiving the plurality of containers;

a bottom retainer comprising a bottom attachment panel for being attached to the plurality of containers, the bottom retainer comprises bottom container retention features including a plurality of bottom container retention tabs foldably connected to the bottom attachment panel for being attached to a respective container of the plurality of containers, each bottom container retention tab of the plurality of bottom container retention tabs comprises a plurality of lines of weakening defining a plurality of reconfigurable sections of the respective bottom container retention tab, the top attachment panel is free from attachment to the bottom attachment panel; and handle features, the handle features comprising at least one handle flap foldably connected to the top attachment panel, the at least one handle flap at least partially separable from the top attachment panel for exposing a handle opening.

10. In combination, a top container retention blank and a bottom retention container blank for forming a carrier for holding a plurality of containers, the combination comprising:

a top container retention blank comprising a top attachment panel for at least partially receiving the plurality of containers when the carrier is formed from the top container retention blank and the bottom container retention blank; and a bottom container retention blank comprising a bottom attachment panel for being attached to the plurality of containers when the carrier is formed from the combination of the top container retention blank and the bottom container retention blank and comprising a plurality of bottom container retention tabs foldably connected to the bottom attachment panel and at least partially separable from the bottom attachment panel at a respective cut in the bottom attachment panel for being attached to a respective container of the plurality of containers when the carrier is formed from the top container retention blank and the bottom container retention blank, each bottom container retention tab of the plurality of bottom container retention tabs comprises a plurality of lines of weakening defining a plurality of reconfigurable sections of the respective bottom container retention tab, the top attachment panel is free from attachment to the bottom attachment panel.

11. The combination of claim 10, wherein each reconfigurable section of the plurality of reconfigurable sections is repositionable relative to an adjacent reconfigurable section of the plurality of reconfigurable sections at the respective line of weakening.

12. The combination of claim 11, wherein each bottom container retention tab of the plurality of bottom container retention tabs is foldably connected to the bottom attachment panel at a respective curved fold line.

13. The combination of claim 12, wherein the plurality of bottom container retention tabs is for being adhered to a respective container of the plurality of containers with glue when the carrier is formed from the top container retention blank and the bottom container retention blank.

14. The combination of claim 10, wherein the top container retention blank comprises top container retention features, the top container retention features comprising a plurality of container openings for at least partially receiving a respective container of the plurality of containers when the carrier is formed from the top container retention blank and the bottom container retention blank.

15. The combination of claim 14, wherein the top container retention features further comprises a plurality of top container retention tabs foldably connected to the top attachment panel and positioned extending into a respective container opening of the plurality of container openings for engaging a respective container of the plurality of containers when the carrier is formed from the top container retention blank and the bottom container retention blank.

16. The combination of claim 10, wherein the plurality of bottom container retention tabs are for being at least partially received in a recess of a respective container of the plurality of containers when the carrier is formed from the top container retention blank and the bottom container retention blank.

17. In combination, a top container retention blank and a bottom retention container blank for forming a carrier for holding a plurality of containers, the combination comprising:

a top container retention blank comprising a top attachment panel for at least partially receiving the plurality of containers when the carrier is formed from the top container retention blank and the bottom container retention blank; and a bottom container retention blank comprising a bottom attachment panel for being attached to the plurality of containers when the carrier is formed from the combination of the top container retention blank and the bottom container retention blank, the top attachment panel is free from attachment to the bottom attachment panel, the combination further comprising handle features, the handle features comprising at least one handle flap foldably connected to the top attachment panel, the at least one handle flap at least partially separable from the top attachment panel for exposing a handle opening.

18. A method of forming a carrier for holding a plurality of containers, the method comprising:

obtaining a top container retention blank comprising a top attachment panel;

obtaining a bottom container retention blank comprising a bottom attachment panel and comprising a plurality of bottom container retention tabs foldably connected to the bottom attachment panel and at least partially separable from the bottom attachment panel at a respective cut in the bottom attachment panel for being attached to a respective container of the plurality of containers, each bottom container retention tab of the plurality of bottom container retention tabs comprises a plurality of lines of weakening defining a plurality of reconfigurable sections of the respective bottom container retention tab, the top attachment panel is free from attachment to the bottom attachment panel;

arranging the top attachment panel to form a top retainer for at least partially receiving the plurality of containers; and arranging the bottom attachment panel to form a bottom retainer for being attached to the plurality of containers.

19. The method of claim 18, wherein each reconfigurable section of the plurality of reconfigurable sections is repositionable relative to an adjacent reconfigurable section of the plurality of reconfigurable sections at the respective line of weakening.

20. The method of claim 19, wherein each bottom container retention tab of the plurality of bottom container retention tabs is foldably connected to the bottom attachment panel at a respective curved fold line.

21. The method of claim 20, wherein the plurality of bottom container retention tabs is for being adhered to a respective container of the plurality of containers with glue.

22. The method of claim 18, wherein the top container retention blank comprises top container retention features, the top container retention features comprising a plurality of container openings for at least partially receiving a respective container of the plurality of containers.

23. The method of claim 22, wherein the top container retention features further comprises a plurality of top container retention tabs foldably connected to the top attachment panel and positioned extending into a respective container opening of the plurality of container openings for engaging a respective container of the plurality of containers.

24. The method of claim 18, wherein arranging the top attachment panel and the bottom attachment panel comprises positioning the top attachment panel in generally parallel and spaced relation to the bottom panel.

25. The method of claim 18, wherein the plurality of bottom container retention tabs are for being at least partially received in a recess of a respective container of the plurality of containers.

26. A method of forming a carrier for holding a plurality of containers, the method comprising:

obtaining a top container retention blank comprising a top attachment panel, the top attachment panel further comprises handle features, the handle features comprising at least one handle flap foldably connected to the top attachment panel, the at least one handle flap at least partially separable from the top attachment panel for exposing a handle opening;

obtaining a bottom container retention blank comprising a bottom attachment panel and bottom container retention features including a plurality of bottom container retention tabs foldably connected to the bottom attachment panel for being attached to a respective container of the plurality of containers when the carrier is formed from the top container retention blank and the bottom container retention blank, each bottom container retention tab of the plurality of bottom container retention tabs comprises a plurality of lines of weakening defining a plurality of reconfigurable sections of the respective bottom container retention tab, the top attachment panel is free from attachment to the bottom attachment panel;

arranging the top attachment panel to form a top retainer for at least partially receiving the plurality of containers; and arranging the bottom attachment panel to form a bottom retainer for being attached to the plurality of containers.

27. A package, the package comprising:

a plurality of containers; and a carrier holding the plurality of containers, the carrier comprising:

a top retainer formed from a top container retention blank comprising a top attachment panel at least partially receiving the plurality of containers; and a bottom retainer formed from a bottom container retention blank comprising a bottom attachment panel attached to the plurality of containers and comprising a plurality of bottom container retention tabs foldably connected to the bottom attachment panel and at least partially separated from the bottom attachment panel at a respective cut in the bottom attachment panel and attached to a respective container of the plurality of containers, each bottom container retention tab of the plurality of bottom container retention tabs comprises a plurality of lines of weakening defining a plurality of reconfigurable sections of the respective bottom container retention tab, the top attachment panel is free from attachment to the bottom attachment panel.

28. The package of claim 27, wherein each reconfigurable section of the plurality of reconfigurable sections is repositionable relative to an adjacent reconfigurable section of the plurality of reconfigurable sections at the respective line of weakening.

29. The package of claim 28, wherein each bottom container retention tab of the plurality of bottom container retention tabs is foldably connected to the bottom attachment panel at a respective curved fold line.

30. The package of claim 29, wherein the plurality of bottom container retention tabs is adhered to a respective container of the plurality of containers with glue.

31. The package of claim 27, wherein the top retainer comprises top container retention features, the top container retention features comprising a plurality of container openings at least partially receiving a respective container of the plurality of containers.

32. The package of claim 31, wherein the top container retention features further comprises a plurality of top container retention tabs foldably connected to the top attachment panel and positioned extending into a respective container opening of the plurality of container openings and engaging a respective container of the plurality of containers.

33. The package of claim 27, wherein the top attachment panel is in generally parallel and spaced relation to the bottom panel.

34. The package of claim 27, wherein the plurality of bottom container retention tabs are at least partially received in a recess of a respective container of the plurality of containers.

35. A package, the package comprising:

a plurality of containers; and a carrier holding the plurality of containers, the carrier comprising:

a top retainer comprising a top attachment panel at least partially receiving the plurality of containers;

a bottom retainer comprising a bottom attachment panel attached to the plurality of containers, the bottom retainer comprises bottom container retention features including a plurality of bottom container retention tabs foldably connected to the bottom attachment panel and attached to a respective container of the plurality of containers, each bottom container retention tab of the plurality of bottom container retention tabs comprises a plurality of lines of weakening defining a plurality of reconfigurable sections of the respective bottom container retention tab, the top attachment panel is free from attachment to the bottom attachment panel; and handle features, the handle features comprising at least one handle flap foldably connected to the top attachment panel, the at least one handle flap at least partially separable from the top attachment panel for exposing a handle opening.

* * * * *